US007921514B2

(12) United States Patent
Anillo Crespo et al.

(10) Patent No.: US 7,921,514 B2
(45) Date of Patent: Apr. 12, 2011

(54) HINGE ASSEMBLY FOR VEHICLE DOORS

(75) Inventors: Jose Anillo Crespo, Barcelona (ES); Ainhoa Gesto Blanca, Barcelona (ES)

(73) Assignee: Flexngate Automotive Iberica, S.A., Les Franqueses Del Valles (ES)

( * ) Notice: Subject to any disclaimer, the term of this patent is extended or adjusted under 35 U.S.C. 154(b) by 209 days.

(21) Appl. No.: 12/307,852

(22) PCT Filed: Jun. 29, 2007

(86) PCT No.: PCT/EP2007/005773
§ 371 (c)(1),
(2), (4) Date: Jan. 7, 2009

(87) PCT Pub. No.: WO2008/011956
PCT Pub. Date: Jan. 31, 2008

(65) Prior Publication Data

US 2009/0307874 A1 Dec. 17, 2009

(30) Foreign Application Priority Data

Jul. 27, 2006 (ES) ..... 200602016

(51) Int. Cl.
*E05D 7/10* (2006.01)
*E05D 11/06* (2006.01)

(52) U.S. Cl. ..... 16/266; 16/82; 16/374; 16/380

(58) Field of Classification Search ..... 16/262, 16/265, 266, 82, 374, 380, 83; 296/146.11, 296/146.12; 292/339, 342, 343
See application file for complete search history.

(56) References Cited

U.S. PATENT DOCUMENTS

| | | | | |
|---|---|---|---|---|
| 2,201,594 | A * | 5/1940 | Sitts | 292/76 |
| 3,445,884 | A | 5/1969 | Dangauthier | |
| 5,924,170 | A * | 7/1999 | Papke et al. | 16/321 |
| 6,108,866 | A * | 8/2000 | Waynick, Jr. | 16/82 |
| 6,332,243 | B1 * | 12/2001 | Kim | 16/334 |
| 6,334,236 | B1 * | 1/2002 | Kalliomaki | 16/334 |
| 7,076,836 | B1 * | 7/2006 | Butka | 16/342 |
| 2007/0094844 | A1 * | 5/2007 | Nelson | 16/337 |

FOREIGN PATENT DOCUMENTS

DE 103 56 461 B3 11/2004

* cited by examiner

*Primary Examiner* — Chuck Y. Mah
(74) *Attorney, Agent, or Firm* — Sughrue Mion, PLLC

(57) ABSTRACT

Hinge assembly for vehicle doors that comprises two hinge bodies articulately connected, the articulated connection consisting of at least two articulating formations spaced apart along the axis of rotation of the hinge assembly, each of which consists of a male element situated on a hinge body that can be coupled by moving it in the direction of the axis of rotation of the hinge onto a complementary female element that is situated on the other hinge body, the hinge assembly also comprising a safety element disposed so as to rotate around an axis that is solidly joined to one of the hinge bodies and that can move between at least a release position, wherein it is possible to decouple the male and female elements, and a second position wherein it is inserted between the two aforementioned articulating formations and prevents said male and female elements from becoming decoupled.

8 Claims, 2 Drawing Sheets

HINGE ASSEMBLY FOR VEHICLE DOORS

TECHNICAL FIELD OF THE INVENTION

The invention relates to a hinge assembly for vehicle doors that comprises two hinge bodies articulately connected by the coupling, in the direction of the axis of rotation of the hinge, of male elements situated in a hinge body in corresponding female elements situated in another hinge body, and a safety element for preventing the accidental decoupling of said male and female elements, which would thus disable the articulated connection between the two hinge bodies.

BACKGROUND OF THE INVENTION

Currently, in the automotive sector hinge assemblies that comprise two complementary hinge bodies that can be decoupled by lifting, wherein the two hinge bodies are separated by a relative axial movement along the axis of rotation of the hinge, are widely used due to the advantages that they present over other types of hinges.

This type of hinges makes it possible, when assembling the vehicle, to correctly secure the doors to the frame of the vehicle by fitting the corresponding hinge bodies to said frame and to the vehicle door, respectively, whilst they make it easy to subsequently detach the door by decoupling the hinge bodies, which is necessary to carry out other vehicle assembly operations, such as painting operations. Subsequently, the characteristics of the hinge enable the door to be assembled again in its correct position by simply coupling the hinge bodies.

Once the vehicle assembly operations are complete, it becomes necessary to prevent the easy separation of the door, for which auxiliary components are incorporated into the body of the hinge to prevent accidental or undesired decoupling of the hinge bodies.

By way of an example, patent document DE 10356461 discloses a hinge assembly consisting of a first hinge body articulately connected to a second hinge body, the articulated connection between said hinge bodies being defined by two articulating formations spaced apart along the axis of rotation of the hinge. Each articulating formation consists of a pin situated on the second hinge body that can be coupled to a corresponding hole situated in the first hinge body. The holes of the first hinge body are positioned at the ends of parallel wings, which are adapted to be supported by the second hinge body and to support the weight of the vehicle door.

The above-described hinge assembly includes a safety element that can be inserted between the articulating formations when the pins of the second hinge body are inserted into the corresponding holes of the first hinge body, which prevents said second hinge body from returning in the decoupling direction of the pins. In other words, the safety element prevents the relative movement of the hinge bodies in the direction of their axis of rotation, and therefore the separation of the hinge bodies.

However, to retain the safety element in its operational position, it is necessary for it to include a means of fastening consisting of a groove adapted to tightly house the projecting end of the pin of the upper articulating formation and a projection that is adapted to be inserted into a housing provided for this purpose in the head of the pin of the lower articulating formation. It is therefore necessary for the safety element to be secured to the hinge assembly by its two ends to ensure that it will not become accidentally dislodged.

Document DE 10356461 also anticipates that the head of the lower pin takes the form of an essentially cylindrical pin, the safety element in this case being provided with two notches, one at each end, which are adapted to tightly house the projecting end of the upper pin and the essentially cylindrical portion of the head of the lower pin, respectively. In any case, the safety element must be adapted to the formation of the hinge because, depending on the direction in which the pins extend, the means of fastening must be formed correspondingly. This means that it is not possible to use a single safety element for different hinge assemblies.

The solution disclosed in document DE 10356461 also suffers from the drawback that the safety element adds yet another component to the assembly of the vehicle and specifically to the assembly of the door. The removal of the safety element of the hinge assembly can cause it to be lost if when the door is separated from the vehicle for painting operations if it does not have a special control or a specific protocol for its transfer to the place where the door is assembled on the frame of the vehicle again, when the safety element should be inserted between the articulating formations again.

The lack of versatility of the safety element and the disadvantage of adding another component to the door assembly are the drawbacks resolved, as the main purpose, by the hinge assembly that is the object of the invention.

EXPLANATION OF THE INVENTION

The hinge assembly for vehicle doors according to the invention comprises two hinge bodies that are articulately connected and can be secured to the frame of the car and to one of the doors, respectively, the articulated connection consisting of at least two articulating formations spaced apart along the axis of rotation of the hinge assembly, each of which consists of a male element, situated on a hinge body, which can be coupled by moving it in the direction of the axis of rotation of the hinge onto a complementary female element situated on the other hinge body. The hinge assembly also comprises a safety element that is adapted to be inserted between two articulating formations, in the operational position of the hinge, in order to prevent the male and female elements of the articulating formations from accidentally becoming decoupled.

Essentially, the hinge assembly of the invention is characterised in that the safety element is disposed so as to rotate around an axis that is solidly joined to one of the hinge bodies and which can move between at least a release position, wherein it is possible to decouple the male and female elements due to the movement of one hinge body in relation to the other in the direction of the axis of rotation, and a second position wherein it is inserted between the two aforementioned articulating formations and prevents any movement between the hinge bodies in the direction of the axis of rotation of the hinge.

Preferably, although not necessarily, the safety element is inserted relatively tightly between the two aforementioned articulating formations.

According to another characteristic of the invention, the safety element is provided with a means of retention to secure its position between the two aforementioned articulating formations.

According to one variant of the invention, the means of retention consists of at least one portion of the safety element and a hinge body, which can be pressed together.

According to another variant of the invention, the means of retention consists of at least one portion of the safety element that can be pressed onto a male element of an articulating formation.

In a preferred embodiment, the ends of the means of retention comprise portions of housing on the safety element that tightly house corresponding portions of the male elements of the two aforementioned articulating formations between which the safety element is positioned.

According to another characteristic of the invention, one hinge body is provided with an axis element and the safety element is immovably coupled to said axis element.

According to another characteristic, the safety element is provided with an elastically deformable lateral clip that is adapted to tightly grip the solidly joined axis element of one of the hinge bodies, which helps it to support it in its rotational movement.

BRIEF DESCRIPTION OF THE DRAWINGS

In the attached drawings a hinge assembly for vehicle doors according to the invention is illustrated by means of a non-limiting example. Specifically.

DETAILED DESCRIPTION OF THE DRAWINGS

Figure 1:
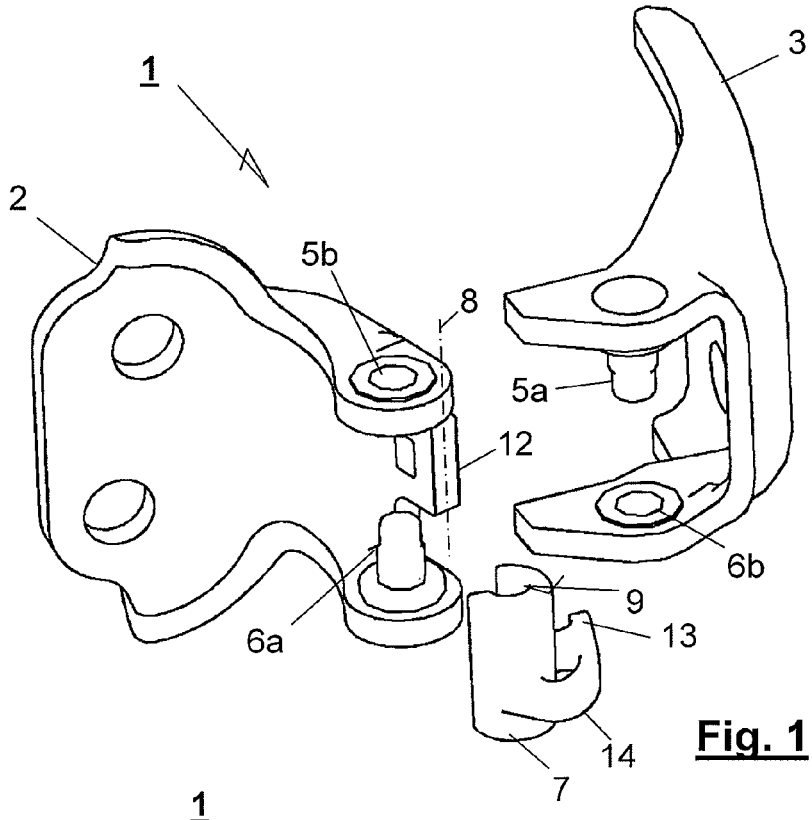
FIG. 1 is a perspective view of the hinge assembly according to the invention with its components separate and in a correlative position of assembly.

FIG. 1 shows a hinge assembly 1 consisting of a first hinge body 2, a second hinge body 3 and a safety element 7. In the example of the figures, the hinge body 2 is secured to the frame of the vehicle whilst the hinge body 3, which can be articulately coupled to the hinge body 2, is secured to the door.

The articulating connection consists of two articulating formations spaced apart, each of which includes a male element situated on a hinge body that can be coupled to a corresponding female element situated on the other hinge body. In the example shown in FIGS. 1 to 4, the first hinge body 2 is provided with a pair of wings, a male element 6*a*, consisting of a pin in the form of a pivot, being situated on the lower wing and a female element 5*b*, consisting of a hole, on the upper wing. Complementarily, the hinge body 3 is also provided with a pair of wings, but contrary to the hinge body 2, a male element 5*a* similar to the male element 6*a* is situated on the upper wing and a female element 6*b* similar to the female element 5*b* is situated on the lower wing. The pins that constitute the male elements 5*a* and 6*a* are secured to their corresponding wing preferably by welding, whilst the holes that constitute the female elements 5*b* and 6*b* include respective bushings with an overhanging outer edge at the opening for insertion of the male element 5*a* or 6*a* which makes it possible to space the moveable adjacent wings of the hinge bodies 2 and 3.

Despite the fact that in FIGS. 1 to 4 the pins that constitute the male elements 5*a* and 6*a* are disposed on different hinge bodies 3 and 2, respectively, facing each other, it should be understood that both pins can be situated on the same hinge body, extending in the same direction, and that the female elements 5*b* and 6*b* are correspondingly situated on the other hinge body.

As regards the hinge body 2, between its wings it is provided with a prolongation with a hole that determines an axis element 12 that is designed to serve as a support for the safety element 7 and to enable it to rotate around the axis 8, which is solidly joined to said hinge body 2.

The safety element 7 consists, in the example shown in FIGS. 1 to 4, of an essentially cylindrical hollow piece, provided with a means of retention 9, as will be explained below, and laterally provided with an elastically deformable clip 13 that is adapted to tightly grip the axis element 12 of the hinge body 2.

Figure 2:
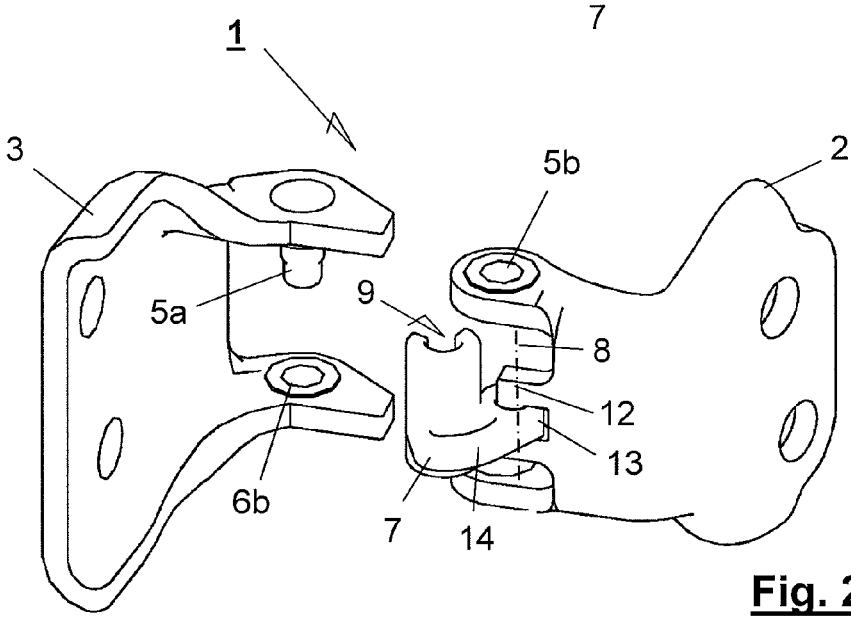
FIG. 2 is also a perspective view of the hinge assembly according to the invention but from the opposite angle, the safety element being coupled to one hinge body.

In effect, as is shown in FIG. 2, the safety element 7 can be moved and coupled to the hinge body 2 by means of the clip 13, which can be pressed onto the axis element 12 of said hinge body 2. Furthermore, the safety element 7 remains coupled to the hinge body 2 with the ability to rotate around the axis 8, thereby enabling said safety element 7 to be moved between at least two positions, one release position (see FIG. 3), wherein it is possible to articulately connect and disconnect the hinge bodies 2 and 3, and another blocking position wherein, with the hinge bodies 2 and 3 articulately connected, any relative movement of said hinge bodies in the axial direction is prevented, thus preventing their disconnection.

Figure 3:
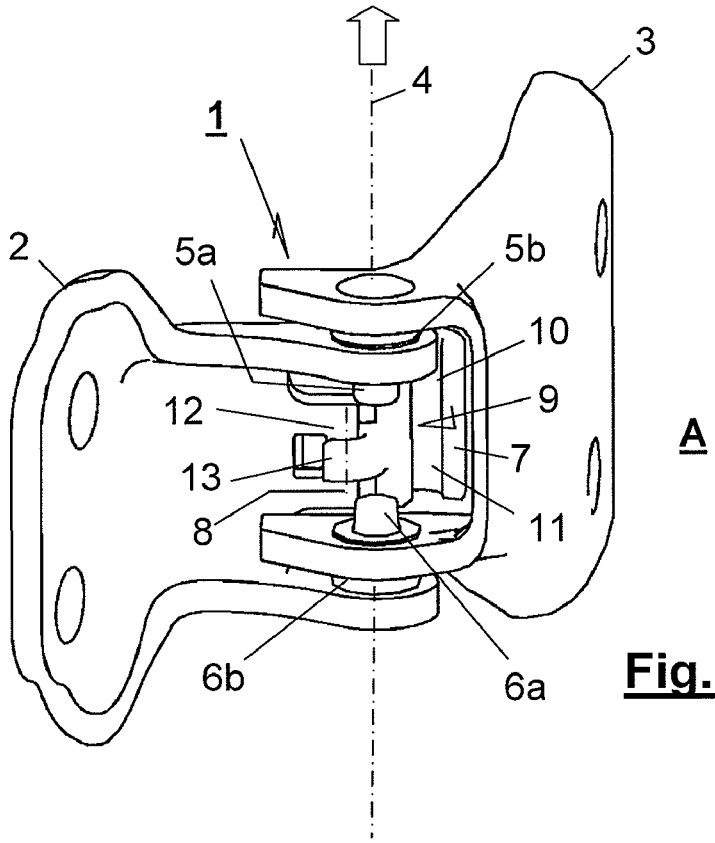
FIG. 3 is a perspective view of the hinge assembly shown in FIGS. 1 and 2, both hinge bodies being suitably coupled, with the safety element in its release position.

FIG. 3 shows the hinge assembly 1 of FIGS. 1 and 2 wherein both hinge bodies 2 and 3 are articulately connected. For this, the hinge bodies 2 and 3 are positioned with their wings alternately disposed and their corresponding male elements 5*a*, 6*a* and their female elements 5*b*, 6*b* axially aligned, and subsequently the former have been inserted into the latter to bring about the coupling between the male elements 5*a* and 6*a* and the corresponding female elements 5*b* and 6*b*. In the position shown here, the hinge bodies 2 and 3 are articulately connected around the axis of rotation 4 of the hinge.

In the same FIG. 3, it can be observed that the safety element 7, coupled to the hinge body 2, is disposed in the release position A. In this position, the safety element is not disposed between the articulating formations of the hinge assembly 1 whereby the relative movement between the two hinge bodies 2 and 3 is not prevented in the direction of the axis of rotation 4 and in the direction shown by the arrow in FIG. 3. Therefore, by raising the hinge body 3 it is possible to simultaneously decouple the male elements 5*a* and 6*a* and their corresponding female elements 5*b* and 6*b*, and to separate the two hinge bodies.

Figure 4:
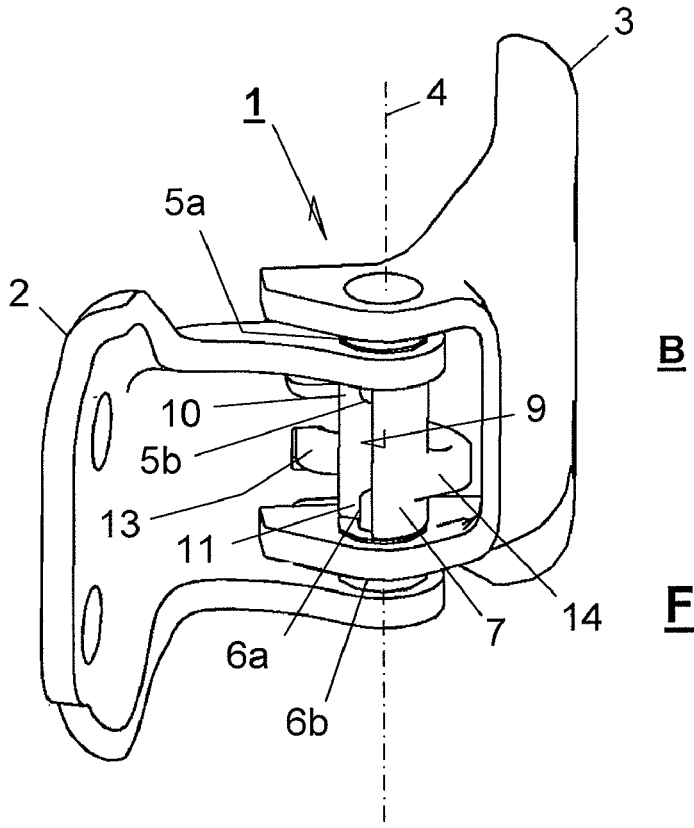
FIG. 4 is a perspective view of the hinge assembly shown in FIG. 3, wherein the safety element is retained between the two articulated formations of the first and second hinge bodies, preventing any relative movement of said hinge bodies in the direction of their axis of rotation.

Otherwise, in the situation shown in FIG. 4, the safety element 7, coupled to the hinge body 2, is disposed in a blocking position B wherein it is disposed between the articulating formations of the hinge assembly 1, preventing the hinge body 3 from being raised by limiting the lower wing of the hinge body 3 and/or the upper wing of the hinge body 2, and therefore preventing the separation of the two hinge bodies 2 and 3.

FIG. 4 shows the operational position of the hinge assembly 1, and as such it must be ensured that it cannot be altered accidentally. For this reason, the safety element 7 is provided with a means of retention 9 to secure its position between the two aforementioned articulating formations.

In the example shown in FIGS. 1 to 4, the safety element 7 consists of an essentially cylindrical single clip whose approximate length is that of the distance that separates the two articulating formations in the operational position of the hinge assembly 1 shown in FIG. 4, i.e. whose approximate length is the distance that separates the lower wing of hinge body 3 from the upper wing of hinge body 2. The safety element can therefore be tightly inserted between said articulating formations, preventing any relative movement between the hinge bodies 2 and 3 in the direction of the axis of rotation 4.

The means of retention 9 consists of a longitudinal groove that extends from one end to the other of the piece that constitutes the safety element 7, which is adapted to receive the lateral insertion of the projecting ends of the male elements 5*a* and 6*a* on their end portions 10 and 11, respectively, and to retain them therein under pressure. For this purpose, the piece that constitutes the safety element is elastically deformable, it being possible to force open the longitudinal groove by inserting the male elements 5*a* and 6*b* therein, as shown in FIG. 4. To aid the entry of said male elements 5*a* and 6*a*, the edges of the longitudinal groove of the safety element 7 are disposed in a slight V shape, both being coplanar to respective planes that pass along the axis of rotation of the piece that constitutes said safety element 7.

Unlike known embodiments, the means of retention of the safety element 7 could be designed to be fastened to a single male or female element by one of its ends, as the articulated joint with the hinge body 2 prevents the safety element 7 from becoming dislodged by the movement of its free end, which is not secured to a male or female element. In this case, the friction between fixed and moving parts is reduced, thereby aiding the rotation between the hinge bodies 2 and 3 around their axis of rotation 4.

Furthermore, the safety element 7 shown in FIGS. 1 to 4 is retained between the articulating formations and in the operational position of the hinge assembly 1, both if the two male elements 5*a* and 6*a* are opposed, as is the case of FIGS. 1 and 4, and in the case wherein they extend in the same direction. It is only necessary for one male element to be orientated towards the space that separates the articulating formations to ensure that the safety element 7 is secured in its operational position.

The invention also contemplates the possibility of the means of retention 9 of the safety element 7 consisting of at least one portion of said safety element 7 that can be pressed onto a portion of a hinge body 2 or 3, and preferably of the same hinge body 2 to which it is articulately joined. According to a variant that is not shown, the safety element could be provided with an axial protuberance on the edge of one of its ends that could be pressed into an opening situated on the wing of the hinge body adjacent to or adjoining said end of the safety element 7.

It should also be mentioned that, with the safety element 7 joined to the hinge body 2, it is not necessary for the former to be fitted tightly between the two articulating formations of the hinge assembly 1, it would be sufficient for the safety element to prevent the movement needed to decouple the male elements 5*a* and 5*b* from their corresponding female elements 5*b* and 6*b*, respectively, enabling a certain amount of play in the movement according to the axial direction between the first and second hinge bodies, which can sometimes be useful.

In FIGS. 1, 2 and 4 it can be seen that the piece that constitutes the safety element 7 is provided with a protuberance 14 that extends transversally along a portion of the profile of said piece, situated at the level of the clip 13 and connected to it in the example shown in FIGS. 1, 2 and 4, which is designed to aid the movement of the safety element 7 from its release position A to the blocking position B, or vice versa, exerting a slight pressure on said protuberance 14 that is sufficient to cause the safety element 7 to rotate around the axis 8.

The invention claimed is:

1. Hinge assembly (1) for vehicle doors that comprises two hinge bodies (2, 3) articulately connected and respectively secured to the frame of the car and to one of its doors, the articulated connection comprising at least two articulating formations spaced apart from each other along the axis of rotation (4) of the hinge assembly, each of which comprises a male element (5*a*, 6*a*), situated on one of the hinge bodies, adapted to be coupled by moving the male element in the direction the axis of rotation of the hinge onto a complementary female element (5*b*, 6*b*) that is situated on the other one of the hinge bodies, the hinge assembly also comprising a safety element (7) that is configured to be inserted between said two articulating formations in the operational position of the hinge in order to prevent the accidental decoupling of the male and female elements of the articulating formations, wherein said safety element is disposed such that, by exerting a pressure thereon, said safety element is rotatable around an axis (8) that is solidly joined to one of the hinge bodies and moveable between at least a release position (A), wherein the male and female elements can be decoupled by moving one hinge body in relation to the other in the direction of the axis of rotation, and a blocking position (B) wherein the safety element is inserted between the two aforementioned articulating formations and prevents the movement needed between the hinge bodies in the direction of the axis of rotation of the hinge to decouple said male and female elements.

2. Hinge assembly (1) according to claim 1, wherein the safety element (7) is inserted relatively tightly between the two aforementioned articulating formations.

3. Hinge assembly (1) according to claim 1, wherein the safety element (7) is provided with a means of retention (9) to secure its position between the two aforementioned articulating formations.

4. Hinge assembly (1) according to claim 3, wherein the means of retention (9) comprises at least one portion of the safety element (7), which can be pressed together onto at least a portion of the hinge bodies.

5. Hinge assembly (1) according to claim 3, wherein the means of retention (9) comprises at least one portion (10) of the safety element (7) that can be pressed onto at least one of the male elements (5*a*) of said articulating formations.

6. Hinge assembly (1) according to claim 5, wherein the means of retention (9) comprises end housing portions (10, 11) on the safety element (7) that are designed to tightly house corresponding portions of the male elements (5*a*, 6*a*) of the two aforementioned articulating formations between which the safety element is disposed.

7. Hinge assembly (1) according to claim 1, wherein one of the hinge bodies (2) is provided with an axis element (12) and the safety element (7) is immovably coupled to said axis element.

8. Hinge element (1) according to claim 7, wherein the safety element (7) is provided with an elastically deformable lateral clip (13) that is configured to tightly grip the axis element (12) of one of the hinge bodies (2), which helps to support rotational movement of the hinge.

* * * * *